United States Patent [19]

Newman

[11] 3,968,523

[45] July 13, 1976

[54] METHOD FOR PRODUCING A ZIPPER CLOSABLE GARMENT POCKET AND A POCKET PROVIDED THEREBY

[76] Inventor: Sydney Newman, 1245 Avenue X, Brooklyn, N.Y. 11235

[22] Filed: Jan. 20, 1975

[21] Appl. No.: 542,224

[52] U.S. Cl. ..... 2/252; 2/265; 24/205 R; 24/205.16 R; 112/265

[51] Int. Cl.[2] ..... A41D 27/20

[58] Field of Search ..... 2/247, 251, 252, 254, 2/265; 112/265; 24/205 R, 205.16 R, 201 C

[56] References Cited

UNITED STATES PATENTS

| | | | |
|---|---|---|---|
| 2,388,516 | 11/1945 | Altobelli | 2/247 |
| 2,527,224 | 10/1950 | Landy | 2/252 |
| 2,573,046 | 10/1951 | Natzler et al. | 24/205.16 R |
| 2,823,388 | 2/1958 | Prupis et al. | 2/265 X |
| 3,081,462 | 3/1963 | Radousky et al. | 2/265 |
| 3,225,429 | 12/1965 | Fady | 2/265 X |
| 3,570,434 | 3/1971 | Gustavsson | 112/265 |
| 3,685,562 | 8/1972 | Ausnit | 24/201 C X |
| 3,710,745 | 1/1973 | Yoshikawa | 112/265 |
| 3,725,959 | 4/1973 | Cruden | 2/247 |
| 3,777,314 | 12/1973 | Boser | 2/265 |

*Primary Examiner*—Werner H. Schroeder
*Assistant Examiner*—Moshe I. Cohen
*Attorney, Agent, or Firm*—Hubbell, Cohen, Stiefel & Gross

[57] ABSTRACT

A method for providing in a garment, at a predetermined pocket location therein, a closable pocket entry having a zipper closure therefor which comprises the steps of providing a zipper fastener tape having a pair of substantially continuous zipper teeth chains along the outermost extremities thereof, which tape is secured to the garment at the predetermined location adjacent each of the zipper teeth chains with the chain being located along the outermost opposed extremities of the zipper fastener tape. The garment is cut at the predetermined location to provide a substantially continuous slit for the pocket entry and each of the pair of opposed extremity zipper teeth chains are bent until the chains are in opposed adjacent relationship with means being provided thereon for completing the formation of the secured closable zipper at the pocket entry in order to provide the zipper closure therefor.

10 Claims, 7 Drawing Figures

FIG. 1
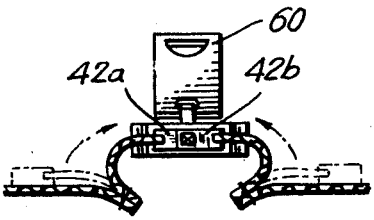
FIG. 2
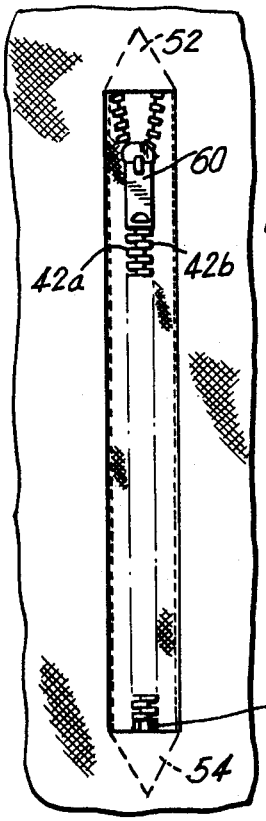
FIG. 4
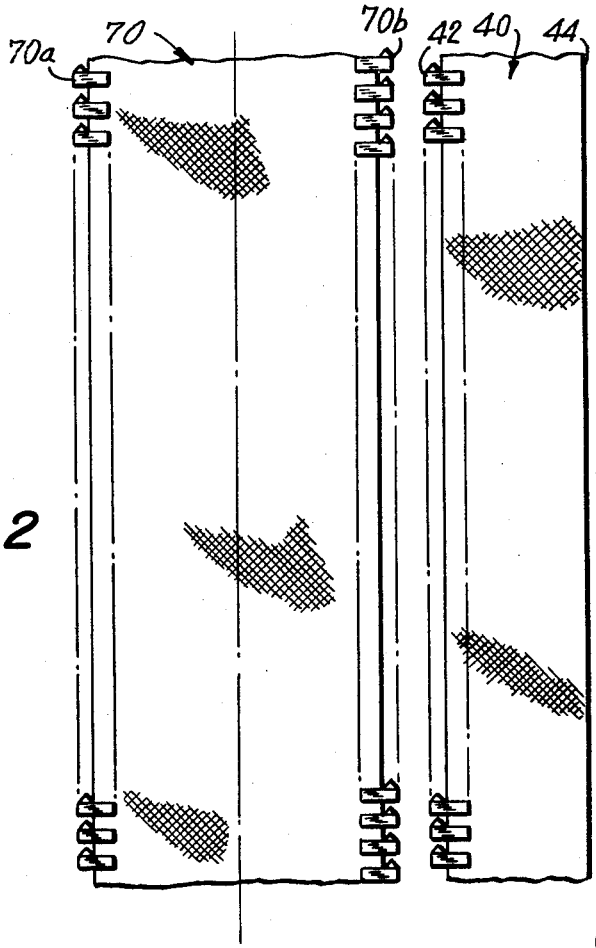
FIG. 5
FIG. 7
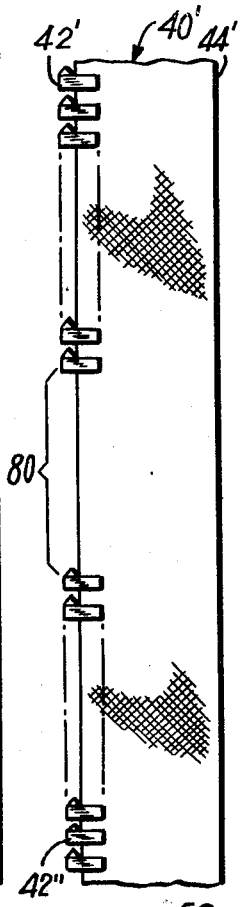
FIG. 3
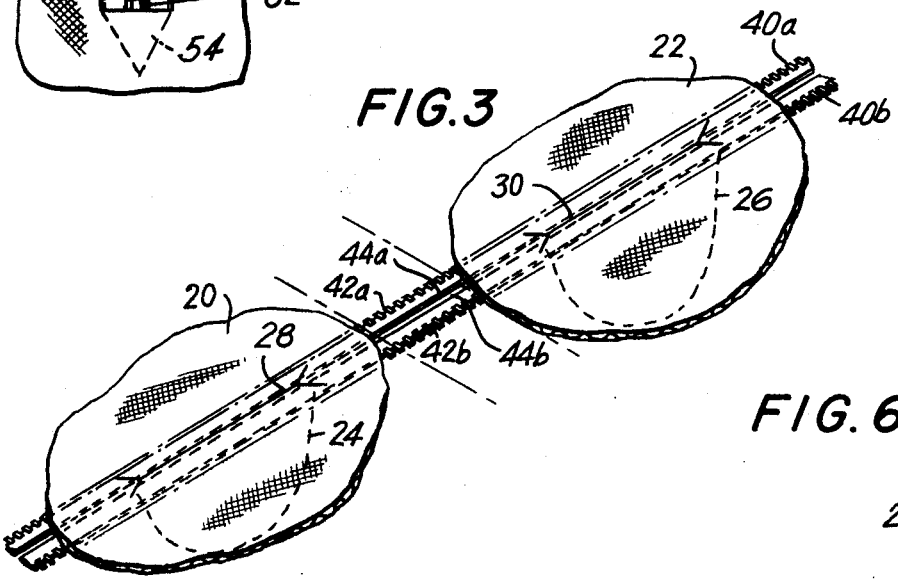
FIG. 6
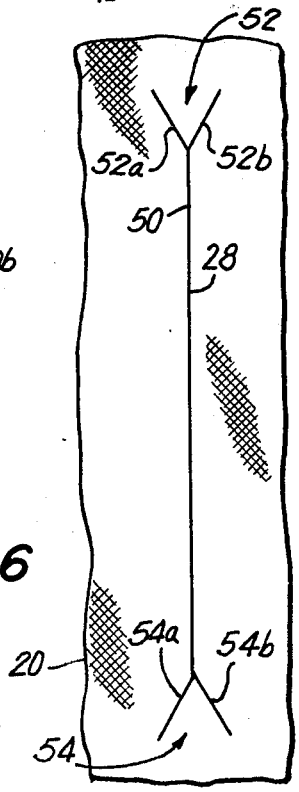

METHOD FOR PRODUCING A ZIPPER CLOSABLE GARMENT POCKET AND A POCKET PROVIDED THEREBY

BACKGROUND OF THE INVENTION

1. Field of the Invention

The present invention relates to a method for providing a closable pocket entry in a garment having a zipper closure therefor and pockets provided thereby.

2. Description of the Prior Art

Zipper closing pockets for garments have been in fashion for a considerable time. However, when such zipper closing pockets are provided in a plurality of mass produced garments, such as by an ordinary dress manufacturer making his Fall line, by prior art techniques for providing such zipper closure pockets these techniques have been inefficient in that the zipper closure for each pocket must be individually sewn on each garment, which is both time consuming and costly. In an attempt to make the mass production of garments employing zippers more efficient, prior art techniques have involved the simultaneous sewing of two halves of a sliding zipper fastener forming part of a continuous fastener tape to several garments substantially simultaneously, as described in U.S. Pat. No. 3,570,434 by way of example; however, the technique disclosed in this reference does not readily lend itself to the mass production of zipper closing pockets. Other prior art techniques employing different types of zipper fasteners which might have application in mass producing garments are disclosed in U.S. Pat. Nos. 2,378,719; 2,784,473; 3,081,462; and 2,638,650. However, none of these prior art zipper fastener tapes have been, to the inventor's knowledge, efficiently employed in mass producing zipper closing pockets in multiple garments. These disadvantages are overcome by the present invention.

SUMMARY OF THE INVENTION

A method for providing in a garment, at a predetermined pocket location therein, a closable pocket entry having a zipper closure means therefor, the method comprising the steps of providing a zipper fastener tape means having a spaced apart pair of substantially continuous zipper teeth chains along at least an outermost extremity thereof; securing the zipper fastener tape means to the garment at the predetermined location adjacent each of the zipper teeth chains with the zipper teeth chain being located along the outermost opposed extremities of the zipper fastener tape means and with the securements for each of the zipper teeth chains being spaced apart; cutting the garment at the predetermined location to provide a substantially continuous slit for the pocket entry, the width of the pocket entry slit being dependent on the spacing of the zipper teeth chain securements bending each of the pair of opposed extremity zipper teeth chains until the pair of zipper teeth chains are in opposed adjacent relationship; and providing means on the opposed adjacent zipper teeth chains for completing the formation of the secured closable zipper at the pocket entry for providing the zipper closure means therefor. In cutting the continuous slit, inwardly tapered slits may be provided at the longitudinal extremities of the pocket entry for providing inwardly tapered V-shaped type flaps at the longitudinal extremities with a centrally located longitudinal slit extending between the apices of the flaps for forming the aforementioned continuous slit, these flaps being tucked under the outer side of the garment to substantially square off the pocket entry. A plurality of closable pocket entries at predetermined pocket locations in a plurality of garments may substantially simultaneously be provided in a mass production type of effort from a continuous zipper fastener tape by providing a continuous zipper fastener tape having a spaced apart pair of substantially continuous zipper teeth chains along each of a pair of the outermost longitudinally extending extremities thereof, such as by utilizing a pair of separate substantially continuous fastener tapes each having a substantially continuous zipper teeth chain along one of the outermost longitudinally extending extremities thereof and a substantially smooth edge as the opposed longitudinal extending extremity thereof with each of the separate fastener tapes being secured to each of the plurality of garments at each of the predetermined locations and with the separate fastener tape longitudinally extending smooth edges adjacent each other substantially along the longitudinal axis of the pocket entry locations. In such an instance, the aforementioned bending and zipper formation completing means providing steps are thereafter accomplished, locking the opposed continuous zipper teeth chains in position adjacent each other after the bending step. Thereafter, the secured lock continuous zipper teeth chain fastener tapes are cut for providing individual separate garments and pocket entry zipper closures therefor. If desired, instead of the separate fastener tapes, a unitary fastener tape having a plurality of longitudinally spaced apart pairs of opposed zipper teeth chain segments may be provided, the longitudinal extent of each pair of opposed segments being dependent on the desired longitudinal extent of the pocket entry being provided and with the zipper tape being secured to the garment by securing one of the pair of opposed segments in each of the predetermined locations, or, if desired, the unitary fastener tape may comprise continuous zipper teeth chain on the opposed outermost longitudinal extremities thereof with the zipper tape being cut at the time that the pocket entry is cut after the zipper tape is secured at the proper predetermined location so as to enable the opposed pairs of zipper teeth chain to be placed in opposed adjacent relationship for forming the zipper closure for the pocket entry.

BRIEF DESCRIPTION OF DRAWINGS

FIG. 1 is a sectional view of a zipper closure for a pocket entry provided in accordance with the preferred method of the present invention;

FIG. 2 is a plan view of a zipper closable garment pocket provided in accordance with the preferred method of the present invention;

FIG. 3 is a graphical illustration of the preferred method of the present invention;

FIG. 4 is a plan view of an alternative embodiment of a zipper fastener tape utilizable in practicing an alternative method of the present invention;

FIG. 5 is a plan view of the presently preferred fastener tape utilized on the method of FIGS. 1 and 2;

FIG. 6 is a fragmentary diagrammatic illustration of the preferred method of slitting the pocket in accordance with the method of FIGS. 1 and 2; and FIG. 7 is a view similar to FIG. 5 of an alternative embodiment of a fastener tape utilizable in the method of FIGS. 1 and 2.

DETAILED DESCRIPTION OF THE PREFERRED EMBODIMENTS

Referring now to the drawings in detail, the preferred method of the present invention is utilized for making a zippered pocket in a garment, such as in the middle thereof. In the preferred method of the present invention, as illustrated in FIG. 3, a plurality of garments, two such garments 20 and 22 being shown by way of example, in which pockets 24 and 26, respectively, are provided, are preferably arranged adjacent each other with the predetermined locations, such as 28 and 30, respectively, by way of example, for the pocket entry for pockets 24 and 26, respectively, aligned with each other. Thereafter, a pair of separate, substantially continuous zipper fastener tapes, such as the type illustrated in FIG. 5, generally referred to by reference numeral 40, are fed underneath the aligned garments alongside the pocket entry locations 28 and 30 with the tapes as shown and preferred in FIG. 3, having a substantially continuous zipper teeth chain 42 longitudinally extending along one outermost longitudinal extremity and a substantially smooth edge 44 longitudinally extending along the other opposed outermost longitudinal extremity aligned so as to have the smooth edges 44*a* and 44*b* of tapes 40*a* and 40*b* adjacent each other along the longitudinal axis of the pocket entry locations 28 and 30 and with the zipper teeth chain edges 42*a* and 42*b* along the outermost longitudinal extremities. Each of the chains 40*a* and 40*b* are continuously sewn onto several garments, such as 20 and 22 to provide a long zippered chain with a plurality of individual garments, such as 20 and 22, hanging from it. The sewing is accomplished in conventional fashion, to stitch the zipper chains 40*a* and 40*b* to the garments 20 and 22. Thereafter, the pocket entries 28 and 30 are provided for each of the pockets 24 and 26 by preferably slitting the pocket entries 28 and 30 at the predetermined locations in the manner illustrated in FIG. 6 in which a longitudinally extendng continuous slit or longitudinal extent 50 is provided for the desired extent of the pocket entry 28 by way of example, and, at the longitudinal extremities thereof, V-shaped flaps 52 and 54 are preferably provided by providing inwardly tapering diagonal cuts 52*a* and 52*b* to provide flap 52, and 54a and 54b to provide flap 54. These flaps 52 and 54 are thereafter preferably tucked under the outerside of the garment, as illustrated in FIG. 2, to substantially square off the pocket entry 28, by way of example. All of the pocket entries, such as pocket entry 30, are preferably provided in this manner by cutting the pocket entry at the predetermined locations in the various garments. Preferably, at this point, the zipper tapes 40*a* and 40*b* are still uncut and continuously connect the several garments together. The zipper teeth chains 42*a* and 42*b* are in opposed adjacent relationship as illustrated in FIG. 3. Thereafter, a conventional slide is mounted on the fastener teeth to automatically lock the two halves 42*a* and 42*b* in place, a slide 60 being provided at each of the pocket entries for closing the pocket entry, and with a conventional zipper fastener 62 being provided at the other end of the zipper chains 42*a* and 42*b* for each pocket entry so as to provide a conventional zippper closure effect therefor by movement of the slide 60 longitudinally along the zipper teeth 42*a* and 42*b*. Thereafter, the fastener tapes 44*a* and 44*b* are cut at each pocket location just beyond the extremities of the longitudinal extent of each of the pockets which separates the garments into individual separate garments as well as separating the connection between the individual pocket entry zipper closures. At this point, a completed zipper closable pocket of the type illustrated in FIG. 2 is provided.

Alternatively, if desired, a single unitary fastener tape 70 (FIG. 4) having zipper teeth chains along the longitudinal extremities thereof, such as chains 70*a* and 70*b*, may be provided in place of the separate zipper fasteners 44*a* and 44*b*. The teeth 70*a* and 70*b* are preferably longitudinally offset one notch. When the unitary fastener tape 70 illustrated in FIG. 4 is employed in place of the separate fastener tape 44 illustrated in FIG. 5, the same procedure as described above is preferably repeated except that the single unitary fastener tape 70 is aligned with each of the pocket entry locations 28 and 30 and is double stitched so as to secure the fastener tape 70 on either side of the proposed pocket entry slit with the stitching being adjacent the zipper teeth chain 70*a* and 70*b*, and the fastener tape 70 thereafter being cut at the same time as the pocket entry slit 50 and V-shaped flaps 52 and 54 are provided, in the manner previously described and illustrated in FIG. 6, so as to separate the individual garments as well as the individual zipper closures for the pockets. Thus, fastener tape 70 is slit after being secured at the predetermined locations for the pocket entries 28 and 30 with the tape 70 being longitudinally slit substantially in half simultaneously with the provision of slit 50 and being separated from the balance of the continuous zipper chain at each end by means of the diagonal cuts 52*a*–52*b*, and 54*a*–54*b*.

In addition, if desired, the fastener tapes 70 or 40 may be provided with continuous zipper chain segments, as shown in FIG. 7 by 40′, 42′ and 42″, which are separated by a space 80 with the length of the segment 42′ and 42″ preferably being the same longitudinal extent as that desired for the longitudinal extent of the pocket entry. When utilizing such a fastener tape, the longitudinal segments 42′ and 42″ must be respectively lined up at the location where the pocket entry is to be, as opposed to when utilizing tapes 70 and 40 merely running a continuous chain and stitching therealong without the necessity of having to worry where a particular segment of the zipper teeth is longitudinally as long as the location of the tape is in alignment with the V-formed pocket entry slit 50.

In each of the above methods, preferably a plurality of garments substantially simultaneously have zippered pockets provided therein by utilizing continuous zipper teeth fastener chain either of the type illustrated in FIG. 5, FIG. 7, or FIG. 4, with a plurality of pockets having the appropriate zipper fastener tape secured thereto to provide a plurality of interconnected garments connected by means of the continuous zipper teeth fastener tape before the individual zipper pockets are finished. The finishing of the individual zipper pockets also serves to separate the garments into individual garments. Thus, an efficient "mass-production" type of zipper closable pocket garment manufacture is provided. The difference in the separation of garments between the presently preferred method of the present invention, in which separate tapes 40 are utilized as opposed to the alternative method of the present invention in which a unitary tape 70 is initially utilized, is that the individual garments are separated in the presently preferred method after the individual zipper tapes 40 have been secured to the garments and the slide has been inserted on the bent opposed zipper teeth chain 42 to automatically lock the opposed halves in place, whereas when a unitary fastener tape 70 is utilized, the individual garments are separated when the pocket entry slit 50–52*a*–52*b*–54*a*–54*b* is provided.

Thus, by utilizing the preferred method of the present invention, a garment pocket may be provided preferably having a zipper closable pocket entry therefor in which the zipper closure comprises a zipper fastener tape, such as tape 40, 40′ or 70, having a spaced apart pair of substantially continuous zipper teeth chains, such as chain 42, 42′ or 42″, or 70*a* and 70*b*, along the outermost longitudinal extremities thereof with the zipper fastener tape being secured to the garment pocket at a predetermined location for the pocket entry adjacent each of the zipper teeth chains and with the zipper teeth chains along the outermost longitudinal extremities. The pair of secured zipper teeth chains are bent into the pocket entry in opposed adjacent relationship and, preferably a conventional zipper slide is conventionally mounted on the opposed adjacent zipper teeth chain for slidable movement therealong to slidably close the zipper pocket entry. The slit 50 preferably is a centrally located longitudinal slit which is spanned by the slidably closable zipper and, as previously described, preferably includes a pair of opposed inwardly tapering V-shaped type flaps 52 and 54 at the longitudinal extremities of the slit 50 with the flaps 52–64 being tucked under the outerside of the garment pocket to substantially square off the pocket entry. Furthermore, as previously mentioned, each of the zipper fastener tape zipper teeth chains comprising the opposed pair of zipper teeth chains which comprise the zipper closure for the pocket entry are preferably secured to the garment pocket by stitching thereto.

It is to be understood that the above described embodiments of the invention are merely illustrative of the principles thereof and that numerous modifications and embodiments of the invention may be derived within the spirit and scope thereof.

What is claimed is:

1. A method for mass producing in a plurality of garments at predetermined pocket locations therein closable pocket entries each having a zipper closure means therefor comprising the steps of initially providing a unitary substantially continuous fastener tape means having a spaced apart pair of substantially continuous zipper teach chains along each of a pair of the outermost longitudinally extending extremities thereof; securing said continuous zipper fastener tape means to said plurality of garments at said predetermined locations adjacent each of said zipper teeth chains with said securements for each of said zipper teeth chains being spaced apart; cutting each of said plurality of garments at said predetermined locations of said secured zipper fastener tape to each provide a substantially continuous slit for said pocket entry, said fastener tape means and each of said garments being longitudinally slit along the longitudinal axis of said fastener tape means to provide a secured spaced apart pair of opposed extremity zipper teeth chains at each of said pocket entry slits, the width of each of said pocket entry slits being dependent on said zipper teeth chain securement spacing; bending each of said pair of opposed extremity zipper teeth chains until said pair of zipper teeth chains are in opposed adjacent relationship; providing means on said opposed adjacent zipper teeth chains for completing the formation of said secured closable zipper at said pocket entry for providing said zipper closure means therefor; and thereafter cutting said plurality of garments at each of said secured fastener tape means at the extremities of each of said pocket entry slits to simultaneously separate said garments into individual separate garments while providing finished individual separate pocket entry zipper closures therefor; whereby the finishing of the individual zipper pockets also serves to separate the plurality of garments into individual separate garments.

2. A method in accordance with claim 1 wherein said garment cutting step comprises the step of cutting inwardly tapering slits at the longitudinal extremities of the pocket entry for providing inwardly tapered V-shaped type flaps at said longitudinal extremities and cutting a centrally located longitudinal slit extending between the apices of said V-shaped flaps for forming said continuous slit; and said method further comprises the step of tucking said flaps under the outer side of said garment to substantially square off said pocket entry.

3. A method in accordance with claim 1 wherein said securing step comprises the step of securing said zipper fastener tape means by stitching said zipper fastener tape means to the garment adjacent each of said zipper teeth chains.

4. A method in accordance with claim 1 wherein said unitary fastener tape means providing step further comprises the step of providing said fastener tape means with said pair of zipper teeth chains being longitudinally offset substantially one notch.

5. A method in accordance with claim 1 wherein said unitary fastener tape means providing step further comprises the step of providing said fastener tape means with said pair of zipper teeth chains being longitudinally offset substantially one notch.

6. A method in accordance with claim 1 wherein said unitary fastener tape providing means comprises the step of providing said fastener tape means with a plurality of longitudinally spaced apart pairs of opposed zipper teeth chain segments comprising said substantially continuous zipper teeth chains with the longitudinal extent of each pair of opposed segments being dependent on the desired longitudinal extent of said pocket entry; said securing step comprising the step of securing one of said pair of opposed segments at each of said predetermined locations.

7. A method for mass producing in a plurality of garments at predetermined pocket locations therein closable pocket entries each having a zipper closure means therefor comprising the steps of providing a pair of separate substantially continuous fastener tapes each having a substantially continuous zipper teeth chain along one of the outermost longitudinally extending extremities thereof and a substantially smooth edge as the opposed longitudinally extending extremities thereof; securing each of said separate fastener tape means to each of said plurality of garments at each of said predetermined locations with said separate fastener tape means longitudinally extending smooth edges adjacent each other substantially along the longitudinal axis of the pocket entry locations; first cutting each of said plurality of garments at said predetermined locations of said secured zipper fastener tape to each provide a substantially continuous slit for said pocket entry, the width of each of said pocket entry slits being dependent on said zipper teeth chain securement spacing; bending each of said pair of opposed extremity zipper teeth chains until said pair of zipper teeth chains are in opposed adjacent relationship; providing means on said opposed adjacent zipper teeth chains for locking said opposed continuous zipper teeth chains in position adjacent each other; and thereafter cutting said plurality of garments at each of said secured locked continuous zipper teeth chain fastener tapes at the extremities of each of said pocket entry slits to simultaneously separate said garments into individual separate garments while providing finished individual separate pocket entry zipper closures therefor, whereby the finishing of the individual zipper pockets also serves to separate the plurality of garments into individual garments.

8. A method in accordance with claim 7 wherein said first garment cutting step further comprises the step of cutting each of said garments at each of said pocket entry predetermined locations to provide said substantially continuous slits before performing said bending and said zipper formation completing means providing steps.

9. A method in accordance with claim 7 wherein said garment cutting step comprises the step of cutting inwardly tapering slits at the longitudinal extremities of the pocket entry for providing inwardly tapered V-shaped type flaps at said longitudinal extremities and cutting a centrally located longitudinal slit extending between the apices of said V-shaped flaps for forming said continuous slit; and said method further comprises the step of tucking said flaps under the outer side of said garment to substantially square off said pocket entry.

10. A method in accordance with claim 7 wherein said securing step comprises the step of securing said zipper fastener tape means by stitching said zipper fastener tape means to the garment adjacent each of said zipper teeth chains.

* * * * *